US006823933B2

(12) United States Patent
Chiba

(10) Patent No.: US 6,823,933 B2
(45) Date of Patent: Nov. 30, 2004

(54) STACKED-TYPE, MULTI-FLOW HEAT EXCHANGERS

(75) Inventor: Tomohiro Chiba, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/077,907

(22) Filed: Feb. 20, 2002

(65) Prior Publication Data

US 2002/0124999 A1 Sep. 12, 2002

(30) Foreign Application Priority Data

Mar. 8, 2001 (JP) ..... P2001-065007

(51) Int. Cl.[7] ..... F28D 1/03; F28F 3/12; F28F 13/12

(52) U.S. Cl. ..... 165/153; 165/109.1; 165/170; 165/177; 165/179

(58) Field of Search ..... 165/109.1, 153, 165/170, 177, 179, 183, 176

(56) References Cited

U.S. PATENT DOCUMENTS 3,292,690 A * 12/1966 Donaldson ..... 165/170
5,697,433 A * 12/1997 Kato ..... 165/170
6,453,989 B1 * 9/2002 Watanabe et al. ..... 165/177

FOREIGN PATENT DOCUMENTS

JP 57101294 A * 6/1982

* cited by examiner

*Primary Examiner*—Leonard R. Leo
(74) *Attorney, Agent, or Firm*—Baker Botts L.L.P.

(57) ABSTRACT

A stacked-type, multi-flow heat exchanger includes a plurality of heat transfer tubes. Each of the heat transfer tubes includes a first tube plate and a second tube plate connected to the first tube plate, such that the first tube plate and the second tube plate form a refrigerant path within the heat transfer tube. Each of the heat transfer tubes also includes an inner fin having a wave shape, positioned within the refrigerant path and extending in a longitudinal direction along the refrigerant path. Moreover, the heat exchanger includes a plurality of outer fins. The plurality of outer fins and the plurality of heat transfer tubes are stacked alternately. The heat exchanger further includes a plurality of projection portions formed on the first tube plates and the second tube plates, such that the projection portions project into the refrigerant path and extend in an oblique direction relative to the inner fin. Further, the inner fin is connected to the plurality of projection portions.

6 Claims, 13 Drawing Sheets

STACKED-TYPE, MULTI-FLOW HEAT EXCHANGERS

BACKGROUND OF THE INVENTION

1. Field of the Invention

The invention relates generally to stacked-type, multi-flow heat exchangers. More specifically, the invention is directed towards stacked-type, multi-flow heat exchangers for use in an air conditioning system of a vehicle.

2. Description of Related Art

Referring to FIGS. 15–17, a known stacked-type, multi-flow heat exchanger may comprise a plurality of heat transfer tubes 70 and a plurality of outer fins 71, such that heat transfer tubes 70 and outer fins 71 may be alternately stacked. Heat transfer tubes 70 may comprise a first tube plate 72, a second tube plate 73 connected to first tube plate 72, and an inner fin 74 having a wave-shape and extending in a longitudinal direction between first tube plate 72 and second tube plate 73. In such a known stacked-type, multi-flow heat exchanger, when a heat exchange medium, e.g., a refrigerant, is introduced into heat transfer tube 70, the heat exchange medium flows through a plurality of independent paths 75 formed by an interior wall of heat transfer tube 70 and inner fin 74. Moreover, energy in the form of heat is exchanged between air passing through the outside of heat transfer tube 70 and the heat exchange medium.

Nevertheless, because paths 75 are formed independent of one another, the heat exchange medium flowing through one path 75 does not mix with the heat exchange medium flowing through another path 75. Consequently, a heat exchange efficiency of such a known stacked-type, multi-flow heat exchanger may be reduced. Further, as shown in FIG. 17, when such a known stacked-type, multi-flow heat exchanger is used as an evaporator, residual water 77 may be retained at drainage groove portions 76 formed between heat transfer tube 70 and outer fins 71. As such, water 77 may not be properly discharged from drainage groove portions 76.

Japanese (Unexamined) Patent Publication No. H04-155191 describes another known stacked-type, multi-flow heat exchanger which includes offset fins. Each offset fin comprises a plurality of inner fins having a repeating square wave shape. Because of the shape of the inner fins, when the heat exchange medium is introduced in the heat transfer tube, the heat exchange medium flowing through one path mixes with the heat exchange medium flowing through another path. Nevertheless, in such a known stacked-type, multi-flow heat exchanger, because of the shape of the inner fin, the resistivity of the path through which the heat exchange medium flows may increase, and the manufacturing cost of the heat exchanger may increase.

SUMMARY OF THE INVENTION

Therefore, a need has arisen for stacked-type, multi-flow heat exchangers that overcome these and other shortcomings of the related art. A technical advantage of the present invention is that the efficiency of heat transfer between air passing through the outside of the heat transfer tube and the heat exchange medium may increase without substantially increasing the resistivity of the path through which the heat exchange medium flows. Another technical advantage of the present invention is that the efficiency of heat transfer may increase without substantially increasing the cost of manufacturing the stacked-type, multi-flow heat exchanger. Yet another technical advantage of the present invention is that when the stacked-type, multi-flow heat exchanger is used as an evaporator, substantially all of the water may be discharged from drainage groove portions formed between the heat transfer tube and the outer fins.

According to an embodiment of the present invention, a stacked-type, multi-flow heat exchanger is described. The heat exchanger comprises a plurality of heat transfer tubes. Each of the heat transfer tubes comprises a first tube plate and a second tube plate connected to the first tube plate, such that the first tube plate and the second tube plate form a refrigerant path within the heat transfer tube. Each of the heat transfer tubes also comprises an inner fin having a wave shape positioned within the refrigerant path and extending in a longitudinal direction along the refrigerant path, and the heat exchanger also comprises a plurality of outer fins. Moreover, the plurality of outer fins and the plurality of heat transfer tubes are stacked alternately. The heat exchanger further comprises a plurality of projection portions formed on at least one of the first tube plates and at least one of the second tube plates, such that the projection portions project into the refrigerant path and extend in an oblique direction relative to the inner fin. Further, the inner fin is connected to the plurality of projection portions.

According to another embodiment of the present invention, a stacked-type, multi-flow heat exchanger is described. The heat exchanger comprises a plurality of heat transfer tubes, each of which comprises a tube plate. The tube plate comprises a flange portion positioned along a center axis of the tube plate, such that when the tube plate is folded, the flange portion forms a refrigerant path within the heat transfer tube. Each of the heat transfer tubes also comprises an inner fin having a wave shape positioned within the refrigerant path and extending in a longitudinal direction along the refrigerant path. The heat exchanger also comprises a plurality of outer fins, and the plurality of outer fins and the plurality of heat transfer tubes are stacked alternately. The heat exchanger further comprises a plurality of projection portions formed on at least one of the tube plates, such that the projection portions project into the refrigerant path and extend in an oblique direction relative to the inner fin. Further, the inner fin is connected to the plurality of projection portions.

Other objects, features, and advantages of the present invention will be apparent to persons of ordinary skill in the art in view of the following detailed description of the invention and the accompanying drawings.

BRIEF DESCRIPTION OF THE DRAWINGS

For a more complete understanding of the present invention, the needs satisfied thereby, and the objects, features, and advantages thereof, reference now is made to the following descriptions taken in connection with the accompanying drawings.

DETAILED DESCRIPTION OF PREFERRED EMBODIMENTS

Figure 1:
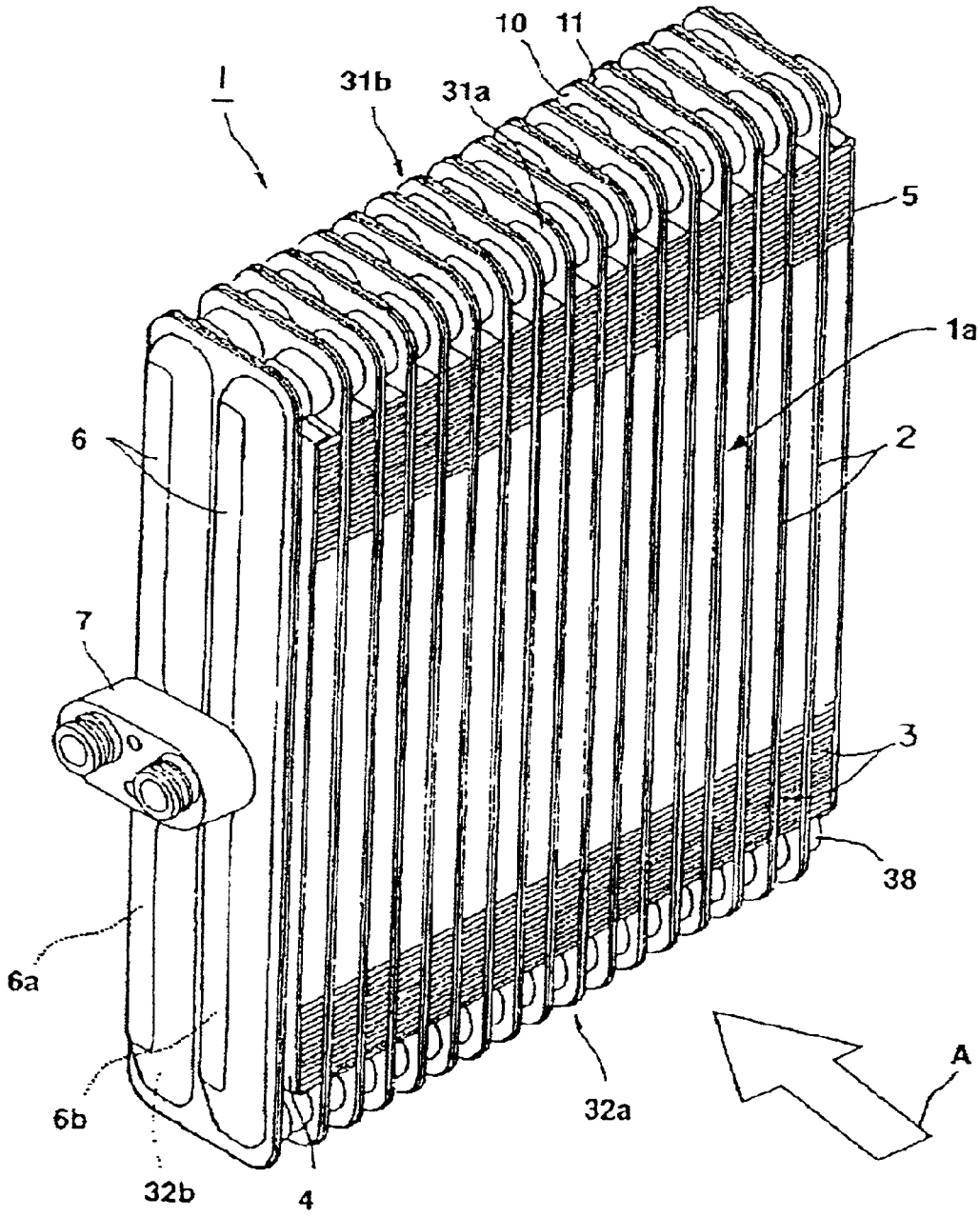
FIG. 1 is a perspective view of a stacked-type, multi-flow heat exchanger according to a first embodiment of the present invention.
Figure 2:
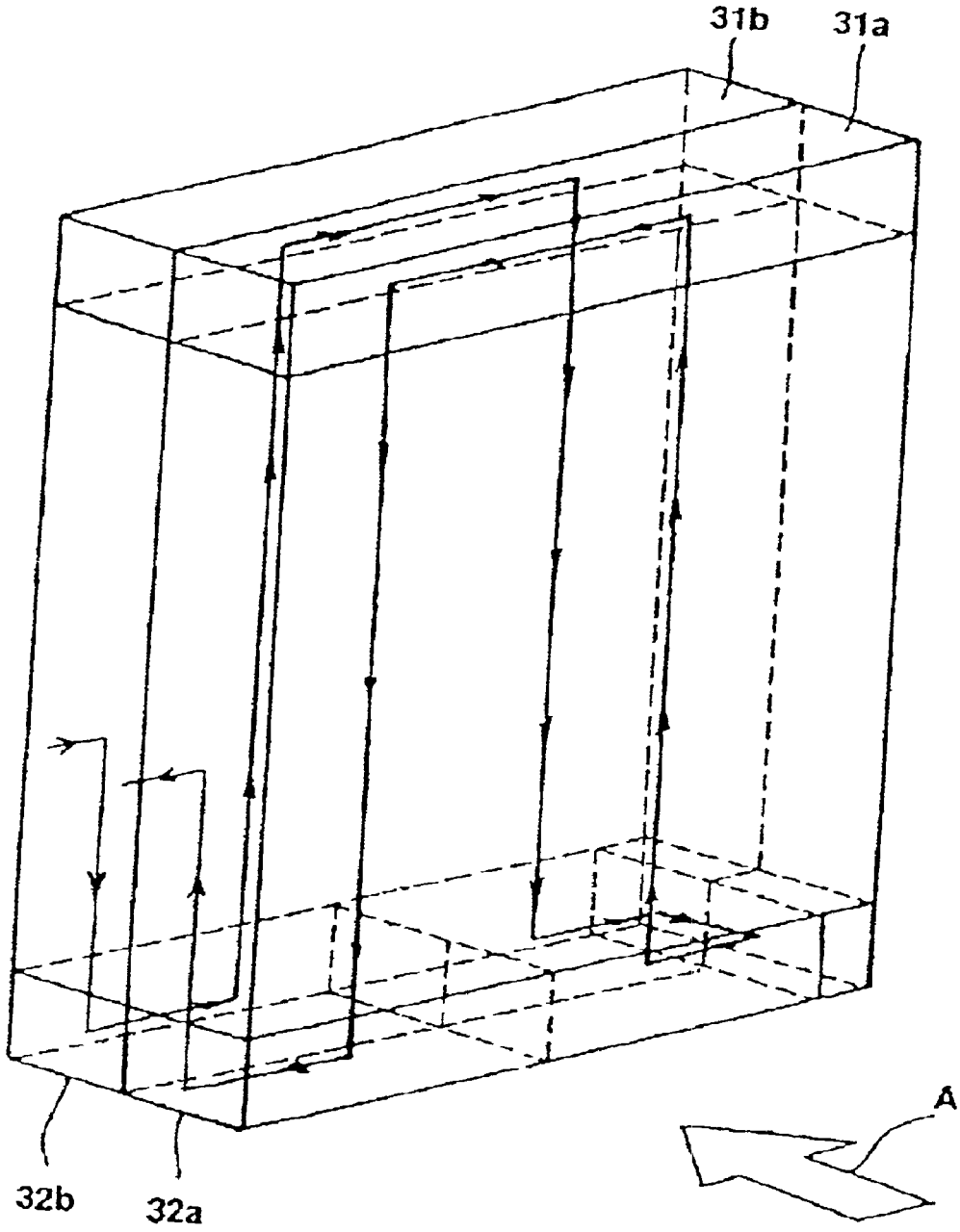
FIG. 2 is a perspective view of a schematic of the stacked-type, multi-flow heat exchanger of FIG. 1, depicting the direction of refrigerant flow within the heat exchanger.

Preferred embodiments of the present invention and their advantages may be understood by referring to FIGS. 1–14, like numerals being used for like corresponding parts in the various drawings.

Referring to FIGS. 1–7, a stacked-type, multi-flow heat exchanger 1 according to a first embodiment of the present invention is described. Heat exchanger 1 may comprise a plurality of heat transfer tubes 2 and a plurality of outer fins 3, such that heat transfer tubes 2 and outer fins 3 are alternately stacked. Each heat transfer tube 2 and the corresponding outer fin 3 form a heat exchanger core la. Each heat exchanger core 1*a* may comprise a first side plate 4 and a second side plate 5 positioned opposite first side plate 4. Heat exchanger 1 also may comprise a side tank 6 formed on an outer first side plate 4, and side tank 6 may form a fluid introduction path 6*a* and a fluid discharge path 6*b*. Moreover, heat exchanger 1 may comprise a flange 7 attached to side tank 6. Flange 7 may allow a heat exchange medium, e.g., a refrigerant, to be introduced into fluid introduction path 6*a*, and also may allow the heat exchange medium to be discharged from fluid discharge path 6*b*. Further, the direction of air passing through heat exchanger 1 is shown as arrow (A), and an expansion valve (not shown) may be attached to flange 7.

Figure 3:
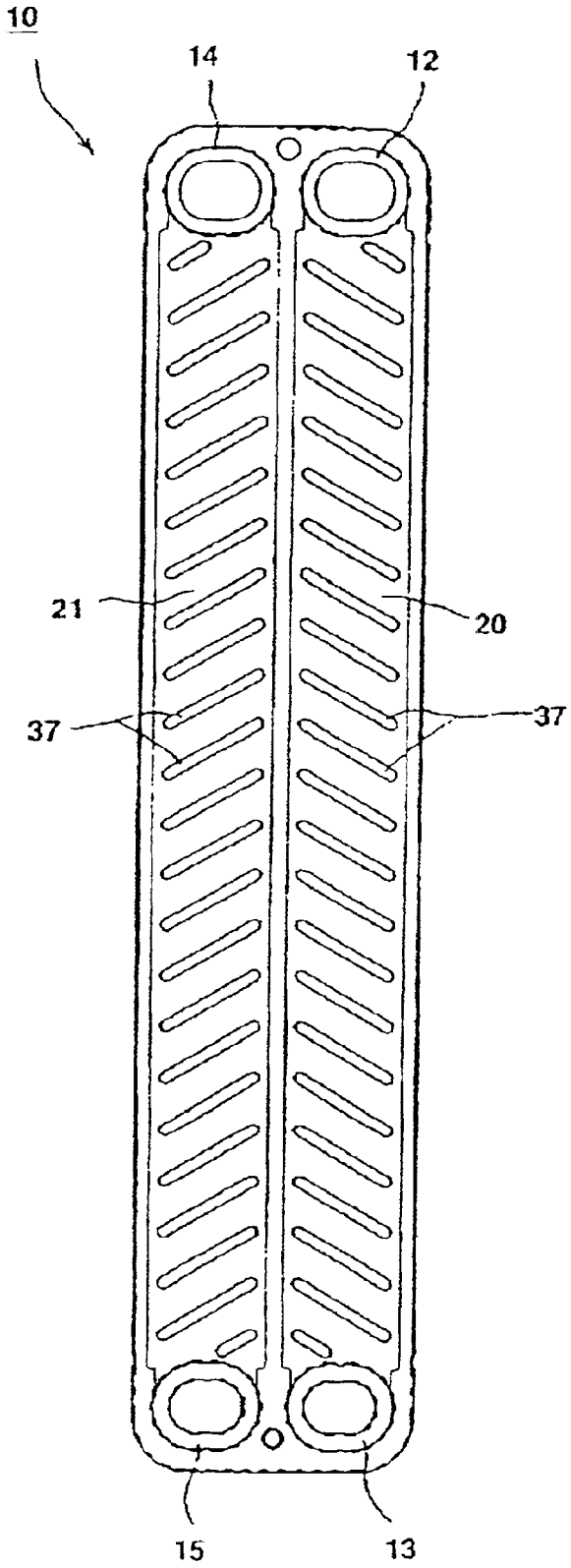
FIG. 3 is a front view of a first tube plate of the stacked-type, multi-flow heat exchanger of FIG. 1.
Figure 4:
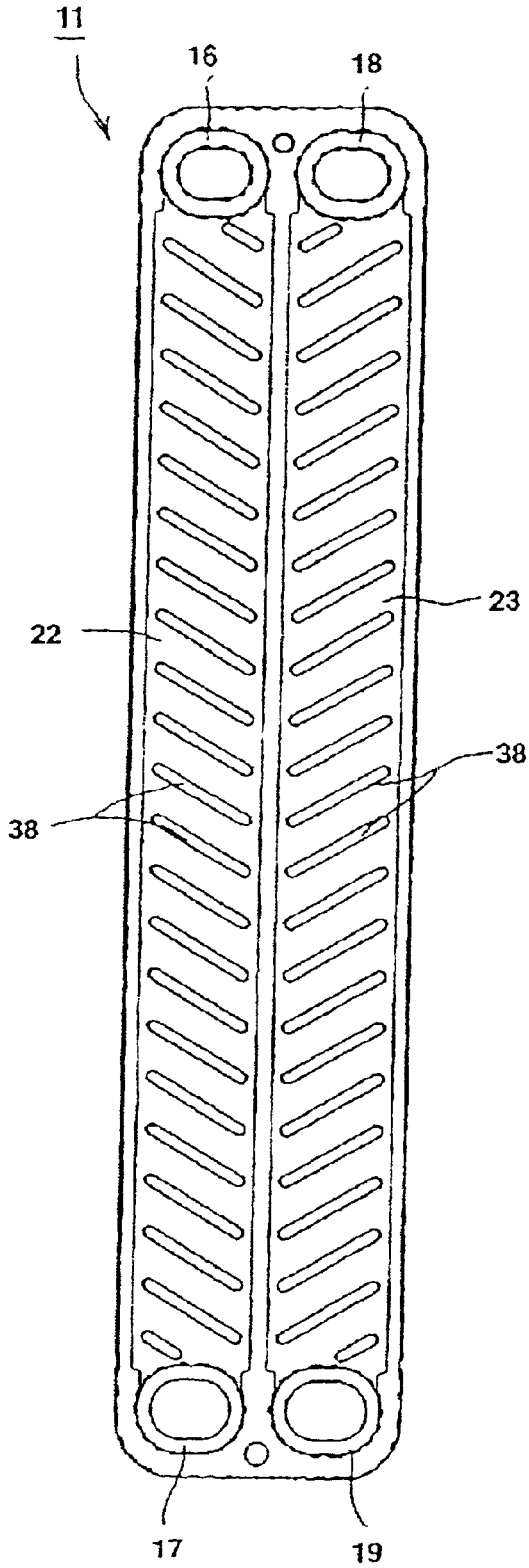
FIG. 4 is a front view of a second tube plate of the stacked-type, multi-flow heat exchanger of FIG. 1.
Figure 7:
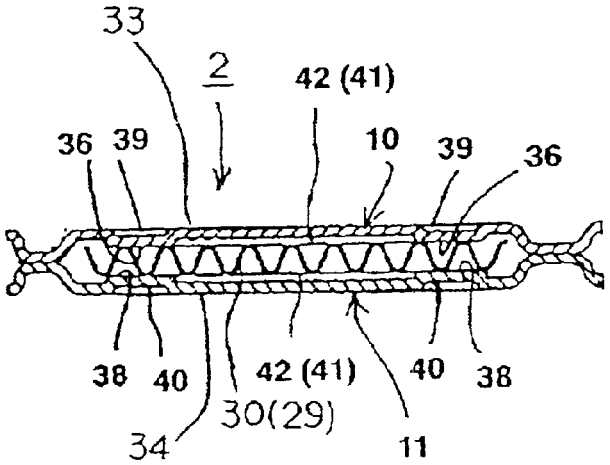
FIG. 7 is a cross-sectional view taken along line VII—VII of FIG. 6.
Figure 8:
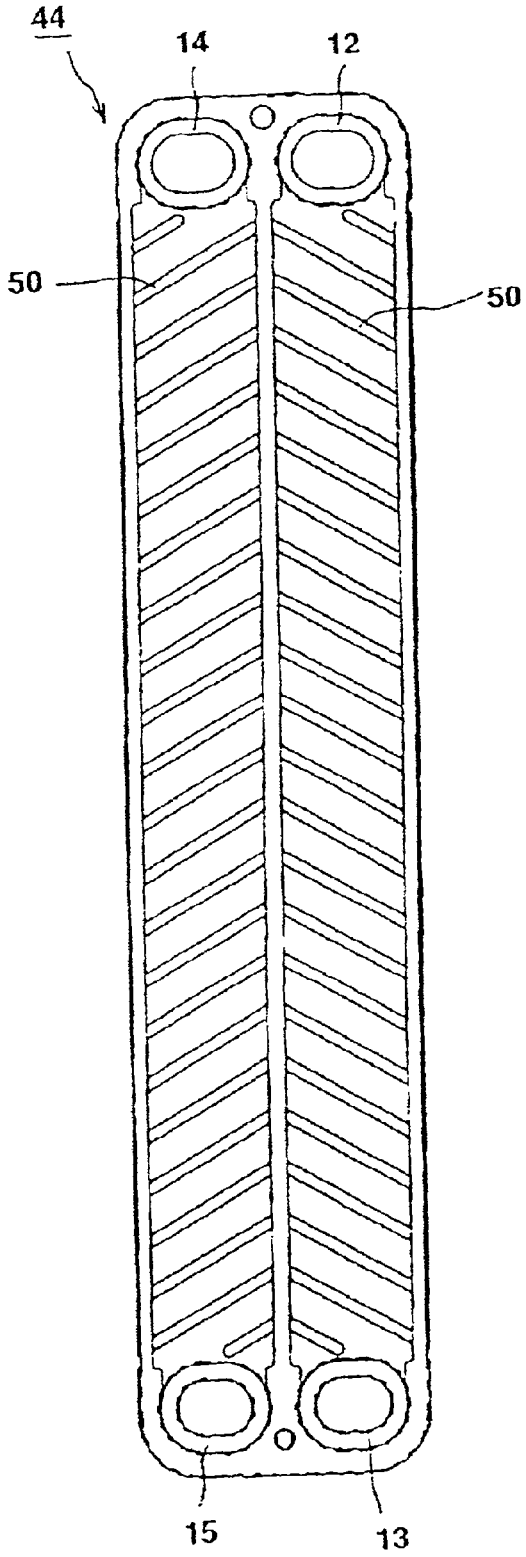
FIG. 8 is a front view of a first tube plate of a stacked-type, multi-flow heat exchanger according to a second embodiment of the present invention.
Figure 9:
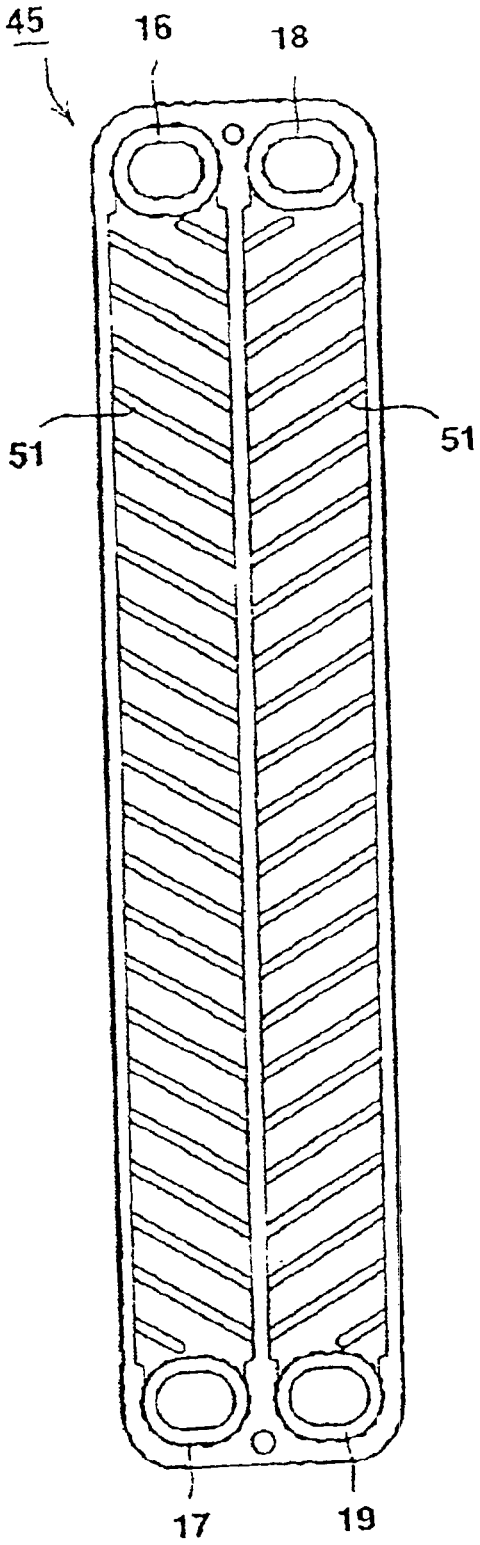
FIG. 9 is a front view of a second tube plate of the stacked-type, multi-flow heat exchanger according to the second embodiment of the present invention.
Figure 10:
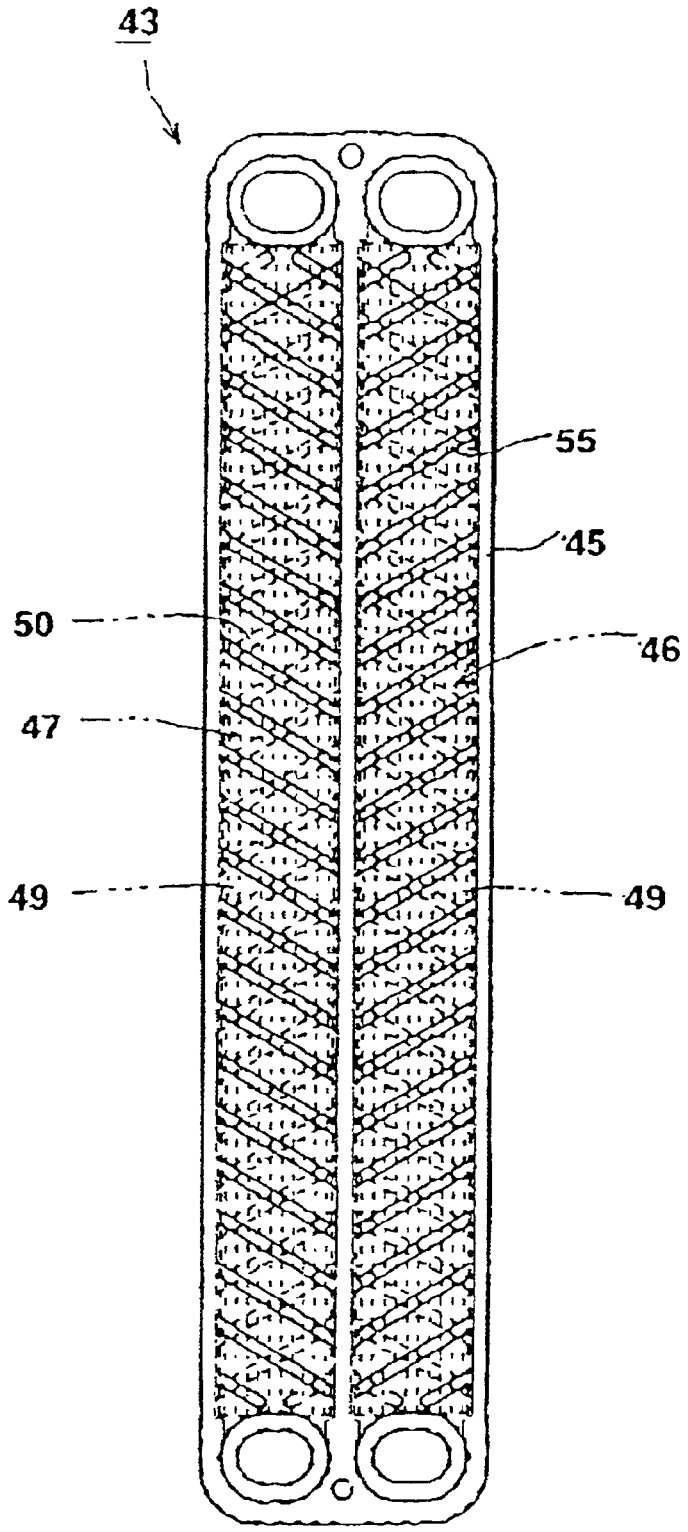
FIG. 10 is a front, cutaway view of a heat transfer tube of the stacked-type, multi-flow heat exchanger according to the second embodiment of the present invention.

Heat transfer tubes 2, other than the heat transfer tube 2 positioned at the center of heat exchanger 1 and other than the outermost heat transfer tube 2 positioned on the side opposite side tank 6, may be formed as shown in FIG. 7. Heat transfer tube 2 may comprise a first tube plate 10 and a second tube plate 11 connected to first tube plate 11. As shown in FIG. 3, projecting hollow portions 12–15 may be formed at a first, a second, a third, and a fourth corner portion of tube plate 10, respectively. Path forming portions 20 and 21 also may be formed on tube plate 10. Moreover, as shown in FIG. 4, projecting hollow portions 16–19 may be formed at a first, a second, a third, and a fourth corner portion of tube plate 11, respectively. Path forming portions 22 and 23 also may be formed on tube plate 11.

Referring to FIGS. 1, 3, and 4, an upper front tank 31*a*, an upper rear tank 31*b*, a lower front tank 32*a*, and a lower front tank 32*b* may be formed by projecting hollow portions 12–19. Specifically, upper front tank 31*a* may be formed by connecting adjacent projecting hollow portions 14 and 18, such that upper front tank 31*a* is positioned at the upstream side with respect to air passing through heat exchanger 1. Similarly, upper rear tank 31*b* may be formed by connecting adjacent projecting hollow portions 13 and 17, such that upper rear tank 31*b* is positioned at the downstream side with respect to air passing through heat exchanger 1. Moreover, lower front tank 32*a* may be formed by connecting adjacent projecting hollow portions 15 and 19, such that lower front tank 32*a* is positioned at the upstream side with respect to air passing through heat exchanger 1. Further, lower rear tank 32*b* may be formed by connecting adjacent projecting hollow portions 12 and 16, such that lower rear tank 32*b* is positioned at the downstream side with respect to air passing through heat exchanger 1.

Figure 5:
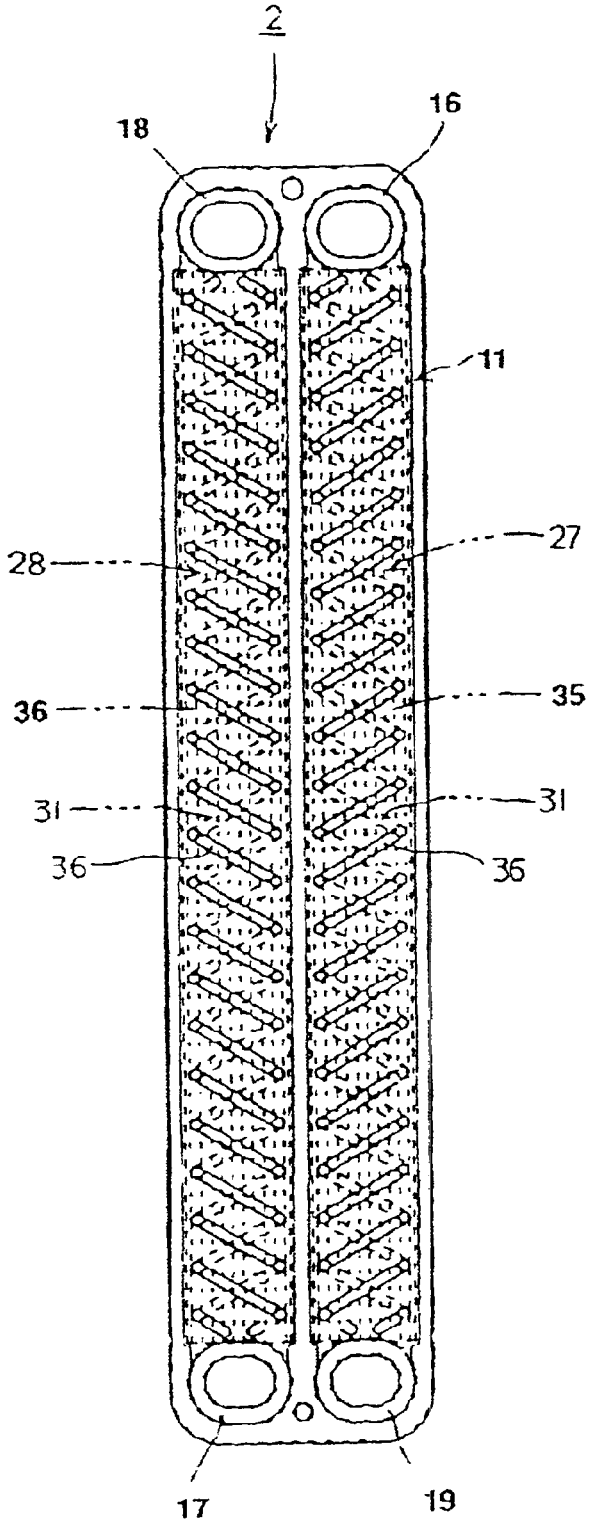
FIG. 5 is a front, cutaway view of a heat transfer tube of the stacked-type, multi-flow heat exchanger of FIG. 1.

As shown in FIG. 5, a first refrigerant path 27 is formed by path forming portions 20 and 22, and a first inner fin 35 having a wave shaped cross-section may be inserted into refrigerant path 27. Similarly, a second refrigerant path 28 is formed by path forming portions 21 and 23, and a second inner fin 36 having a wave shaped cross-section may be inserted into refrigerant path 28.

Referring to FIGS. 3–5, a plurality of projection portions 37 may be formed on first tube plate 10, such that projection portions 37 project towards, i.e., into, refrigerant paths 27 and 28. Projection portions 37 may extend in an oblique, i.e., slanting, direction relative to inner fins 35 and 36. Inner fins 35 and 36 may be connected, e.g., brazed, to projection portions 37. Similarly, a plurality of projection portions 38 may be formed on second tube plate 11, such that projection portions 38 project toward, i.e., into, refrigerant paths 27 and 28. Projection portions 38 may extend in an oblique direction relative to inner fins 35 and 36. Inner fins 35 and 36 also may be connected, e.g., brazed, to projection portions 38. Moreover, when tube plates 10 and 11 are connected to each other, projection portions 37 and 38 may cross or intersect with each other.

Referring to FIG. 7, projection portions 37 may be formed by deforming first tube plate 10 in its entirety. Specifically, first tube plate 10 may be deformed along the entire length of first tube plate 10. Deforming tube plate 10 in its entirety may form a plurality of recess portions 39 on a connection surface 33 of tube plate 10 corresponding to projection portions 37 because connection surface 33 is positioned opposite projection portions 37. Similarly projection portions 38 may be formed by deforming second tube plate 11 in its entirety. Specifically, second tube plate 11 may be deformed along the entire length of second tube plate 11. Deforming tube plate 11 in its entirety may form a plurality of recess portions 40 on a connection surface 34 of plate tube 11 corresponding to projection portions 38 because connection surface 34 is positioned opposite projection portions 38. Moreover, recess portions 38 and 39 maybe adapted to receive outer fin 3.

Figure 6:
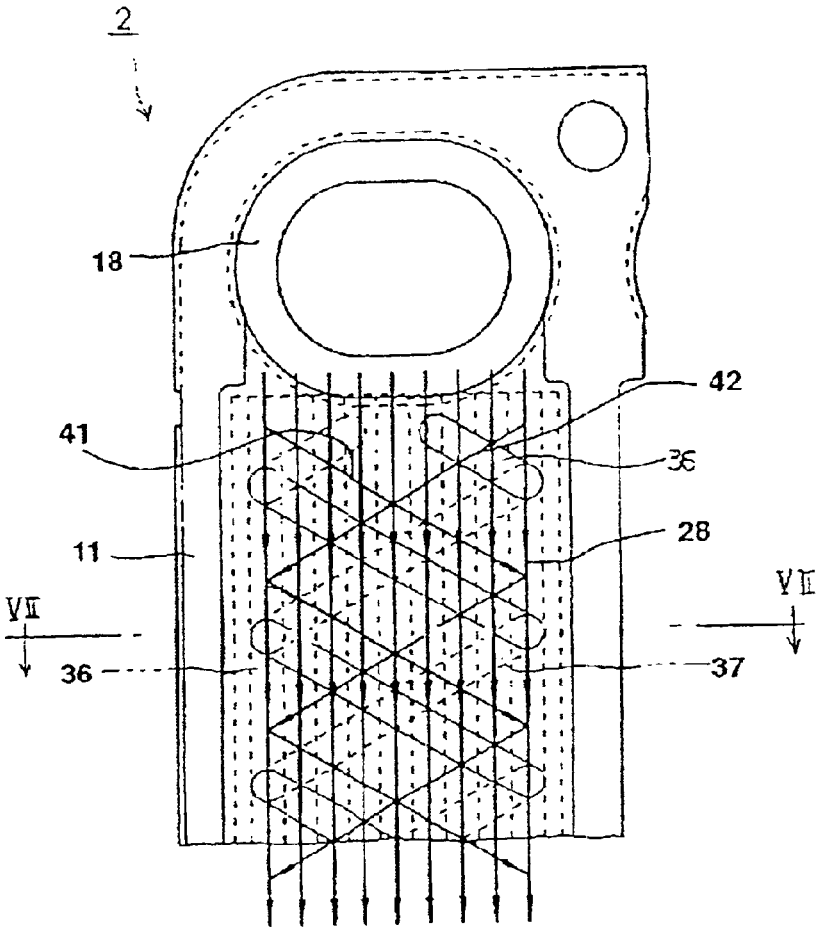
FIG. 6 is an enlarged, front view of a portion of the heat transfer tube of FIG. 5.

Referring to FIGS. 6 and 7, projection portions 37 and 38 also may be connected to wave-shaped inner fins 29 and 30 respectively, thereby forming a first flow channel 41 and a second flow channel 42 within refrigerant paths 27 and 28, respectively. Flow channels 41 and 42 may extend in an oblique direction relative to inner fins 35 and 36, respectively. Consequently, the heat exchange medium flowing through refrigerant paths 27 and 28 may mix together via flow channels 41 and 42, and a heat exchange efficiency of heat exchanger 1 may increase. Moreover, projection portions 37 and projection portions 38 may be formed integrally with inner fin 29 and inner fin 30, respectively, such that the number of parts of heat exchanger 1 may not increase.

Referring to FIGS. 8–12, a staked-type multi-flow heat exchanger according to a second embodiment is described. The features and advantages of the second embodiment are substantially similar to those of the first embodiment. Therefore, the features and advantages of the first embodiment are not described again with respect to the second embodiment. In this embodiment, a heat transfer tube 43 may comprise a first tube plate 44 and a second tube plate 45 connected to first tube plate 44. Refrigerant paths 46 and 47 may be formed within heat transfer tube 43. An inner fin 48 may be positioned within refrigerant path 46, and an inner fin 49 may be positioned within refrigerant path 49.

A plurality of projection portions 50 formed on first tube plate 44 may project towards, i.e., into refrigerant paths 46 and 47. Projection portions 50 may extend in an oblique direction relative to inner fins 48 and 49, and inner fins 48 and 49 may be connected, e.g., brazed, to projection portions 50. Similarly, a plurality of projection portions 51 formed on second tube plate 45 may project towards, i.e., into, refrigerant paths 46 and 47. Projection portions 51 may extend in an oblique direction relative to inner fins 48 and 49, and inner fins 48 and 49 may be connected, e.g., brazed, to projection portions 51. Moreover, when plate tubes 44 and 45 are connected each other, projection portions 50 and 51 may cross or intercept each other.

Projection portions 50 and 51 may be formed across the width of refrigerant paths 46 and 47, respectively. Projection portions 50 may be formed by deforming first tube plate 44 in its entirety. Deforming first tube plate 44 in its entirety may form a plurality of recess portions 45 on a connection surface 52 because connection surface 52 is positioned opposite projection portions 50. Moreover, recess portions 54 may be in fluid communication with a drain path 56. Similarly, projection portions 51 may be formed by deforming second tube plate 45 in its entirety. Deforming second tube plate 45 in its entirety may form a plurality of recess portions 55 on a connection surface 53 because connection surface 53 is positioned opposite projection portions 51. Further, recess portions 55 may be in fluid communication with drain path 56.

Figure 11:
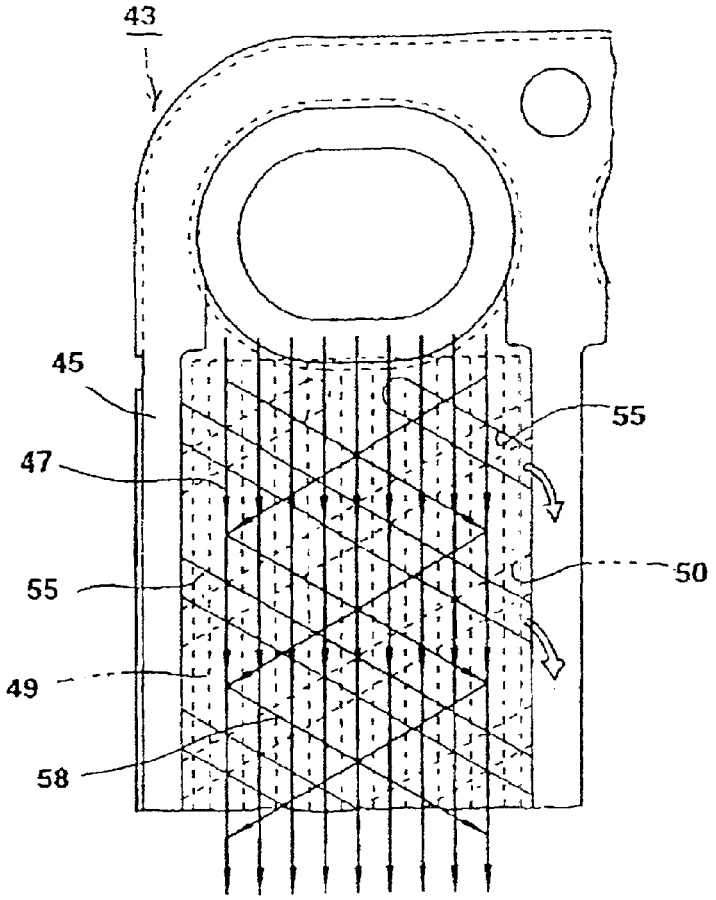
FIG. 11 is an enlarged, front view of a portion of the heat transfer tube of FIG. 10.
Figure 12:
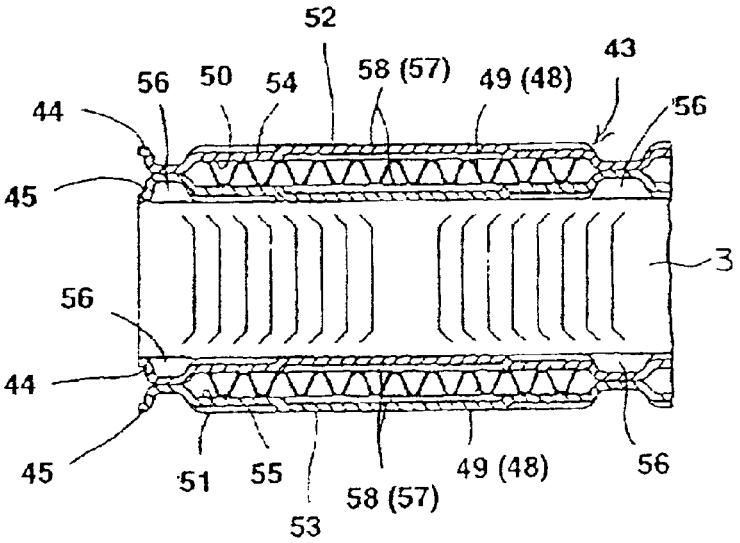
FIG. 12 is an enlarged, cross-sectional view of a portion of the stacked-type, multi-flow heat exchanger according to the second embodiment of the present invention.

Referring to FIGS. 11 and 12, projection portions 50 and 51 also may be connected to wave-shaped inner fins 48 and 49, respectively, thereby forming flow channels 57 and 58 within refrigerant paths 46 and 47, respectively. Flow channels 57 and 58 may extend in an oblique direction relative to inner fins 48 and 49, respectively. Consequently, the heat exchange medium flowing through refrigerant paths 46 and 47 may mix together via flow channels 57 and 58, and a heat exchange efficiency of heat exchanger 1 may increase.

In addition, projection portions 50 and projection portions 51 may be formed integrally with first tube plate 44 and second tube plate 45, respectively, such that the number of parts or components of heat exchanger may not increase. Moreover, because projection portions 50 and recess portions 54 are formed across the width of refrigerant path 46, recess portions 54 may be in fluid communication with drain path 56. Similarly, because projection portions 51 and recess portions 55 are formed across the width of refrigerant path 47, recess portions 55 also may be in fluid communication with drain path 56. Consequently, as shown in FIG. 11, water may not be retained between heat transfer tube 43 and outer fin 3 because recess portions 54 and 55 guide the water to drain path 56.

Figure 13:
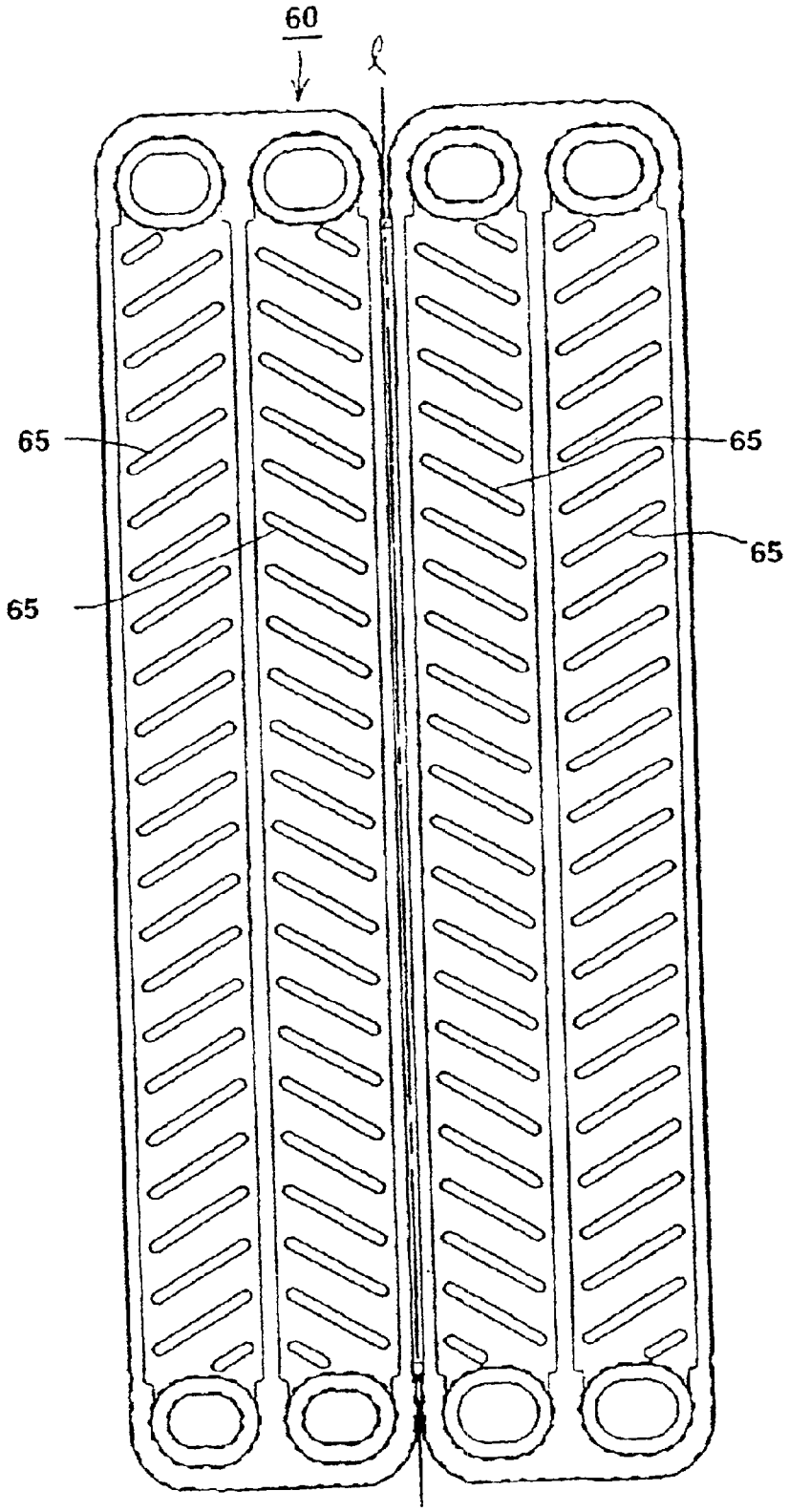
FIG. 13 is a front view of a tube plate of a stacked-type, multi-flow heat exchanger according to a third embodiment of the present invention.
Figure 14:
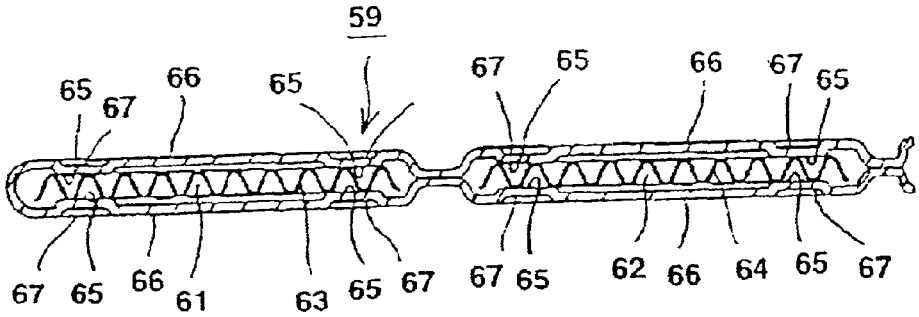
FIG. 14 is a cross-sectional view of a heat transfer tube of the stacked-type, multi-flow heat exchanger according to the third embodiment of the present invention.
Figure 15:
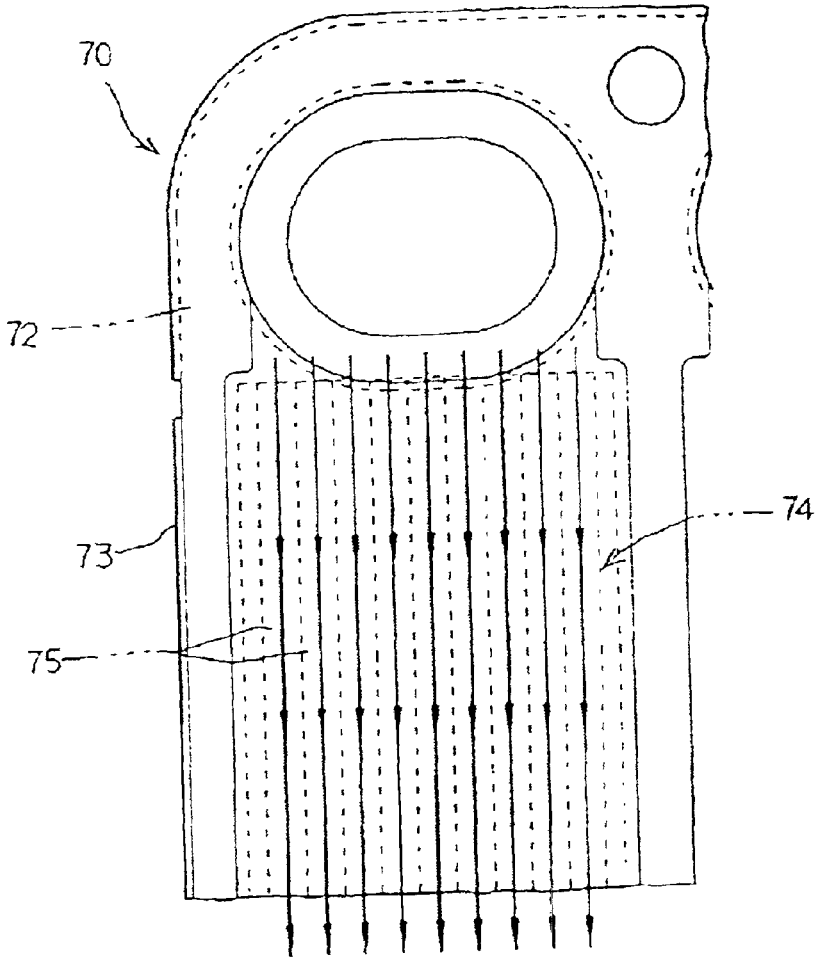
Fig. 15 (Prior Art)
FIG. 15 is an enlarged, front view of a portion of a heat transfer tube of a known stacked-type, multi-flow heat exchanger.
Figure 16:
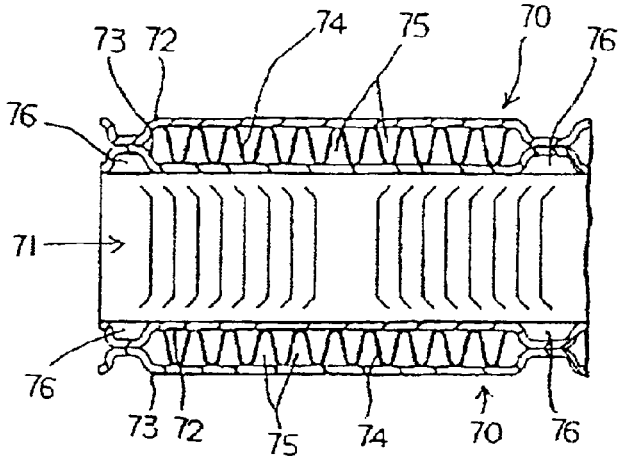
Fig. 16 (Prior Art)
FIG. 16 is an enlarged, cross-sectional view of a portion of a known stacked-type, multi-flow heat exchanger.
Figure 17:
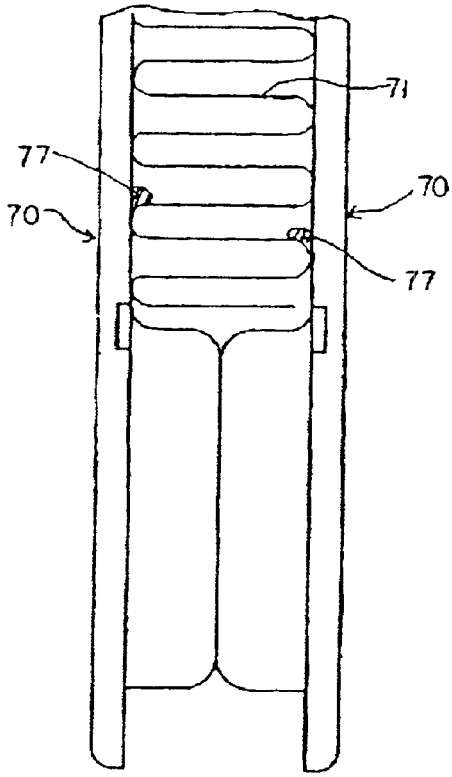
Fig. 17 (Prior Art)
FIG. 17 is an enlarged, cross-sectional view of a portion of the known stacked-type, multi-flow heat exchanger of FIG. 16 depicting drainage groove portions formed between a heat transfer tube and a plurality of outer fins.

Referring to FIGS. 13 and 14, a staked-type, multi-flow heat exchanger according to a third embodiment of the present invention is described. The features and advantages of the third embodiment are substantially the same as those of the forgoing embodiments. Therefore, the features and advantages of the foregoing embodiments are not described again with respect to the third embodiment. In this embodiment, a heat transfer tube 59 may comprise a tube plate 60. Tube plate 60 may comprise a flange portion (not numbered) positioned along a center axis (1) of tube plate 60, such that when tube plate 60 is folded at center axis (1) the flange portion may form refrigerant paths 61 and 62. Moreover, a plurality of projection portions 65 may be formed on heat transfer tube 59, such that projection portions 65 project towards refrigerant paths 61 and 62. Projection portions 65 may be formed by deforming each tube plate 60 in its entirety. Deforming tube plate 60 in its entirety may form a plurality of recess portions 67 on a connection surface 66 because connection surface 66 is positioned opposite projection portions 65. For example, projection portions 65 may be formed by a press working tube plate 60.

Heat transfer tube 59 also may comprise inner fins 63 and 64, which may be connected to an interior surface heat transfer tube 59, e.g., by brazing. In this embodiment, heat exchange medium flowing through refrigerant paths 61 and 62 may mix together in the same manner as described with respect to the foregoing embodiments, and a heat exchange efficiency of heat exchanger 1 may increase.

While the invention has been described in connection with preferred embodiments, it will be understood by those skilled in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described examples are considered as exemplary of the invention indicated by the flowing claims.

What is claimed is:

1. A stacked-type, multi-flow heat exchanger comprising:

a plurality of heat transfer tubes, wherein each of said heat transfer tubes comprises:

a first tube plate;

a second tube plate connected to said first tube plate, wherein said first tube plate and said second tube plate form a refrigerant path within said heat transfer tube; and an inner fin having a wave shape, wherein said inner fin is positioned within said refrigerant path and extends in a longitudinal direction along said refrigerant path;

a plurality of outer fins, wherein said plurality of outer fins and said plurality of heat transfer tubes are stacked alternately;

a plurality of continuous projection portions formed on at least one of said first tube plates and on at least one of said second tube plates, wherein said plurality of projection portions project into said refrigerant path and extend in an oblique direction relative to said inner fin, said inner fin is connected to said plurality of projection portions, and each of said plurality of projection portions are positioned across the entire width of said refrigerant path; and a plurality of recess portions, wherein said plurality of recess portions are formed in a side of at least one of said tube plates opposite and corresponding to said plurality of projection portions.

2. The stacked-type, multi-flow heat exchanger of claim 1 wherein said plurality of projection portions are formed by deforming said at least one first tube plate and said at least one second tube plate.

3. The stacked-type, multi-flow heat exchanger of claim 4, further comprising a drain path, wherein said plurality of recess portions are in fluid communication with said drain path.

4. A stacked-type, multi-flow heat exchanger comprising:

a plurality of heat transfer tubes, wherein each of said heat transfer tubes comprises:

a tube plate, wherein said tube plate comprises a flange portion positioned along a center axis of said tube plate, such that when said tube plate is folded along said center axis, said flange portion forms a refrigerant path within said heat transfer tube; and an inner fin having a wave shape, wherein said inner fin is positioned within said refrigerant path and extends in a longitudinal direction along said refrigerant path;

a plurality of outer fins, wherein said plurality of outer fins and said plurality of heat transfer tubes are stacked alternately;

a plurality of continuous projection portions formed on at least one of said tube plates wherein said plurality of projection portions project into said refrigerant path and extend in an oblique direction relative to said inner fin, said inner fin is connected to said plurality of projection portions, and each of said plurality of projection portions are positioned across the entire width of said refrigerant path; and a plurality of recess portions, wherein said plurality of recess portions are formed in a side of at least one of said tube plates opposite and corresponding to said plurality of projection portions.

5. The stacked-type, multi-flow heat exchanger of claim 4, wherein said plurality of projection portions are formed by deforming said at least one tube plate.

6. The stacked-type, multi-flow heat exchanger of claim 1, further comprising a drain path, wherein said plurality of recess portions are in fluid communication with said drain path.

* * * * *